US008968494B2

(12) United States Patent
Nakagaito et al.

(10) Patent No.: US 8,968,494 B2
(45) Date of Patent: Mar. 3, 2015

(54) HIGH-STRENGTH GALVANNEALED STEEL SHEET HAVING EXCELLENT FORMABILITY AND FATIGUE RESISTANCE AND METHOD FOR MANUFACTURING THE SAME

(75) Inventors: Tatsuya Nakagaito, Nagoya (JP); Yoshiyasu Kawasaki, Fukuyama (JP); Shinjiro Kaneko, Fukuyama (JP); Saiji Matsuoka, Kurashiki (JP); Yoshitsugu Suzuki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/378,501

(22) PCT Filed: Jun. 7, 2010

(86) PCT No.: PCT/JP2010/003780

§ 371 (c)(1),
(2), (4) Date: Feb. 2, 2012

(87) PCT Pub. No.: WO2010/146796

PCT Pub. Date: Dec. 23, 2010

(65) Prior Publication Data

US 2012/0118438 A1 May 17, 2012

(30) Foreign Application Priority Data

Jun. 17, 2009 (JP) ..... 2009-144075

(51) Int. Cl.

| | |
|---|---|
| ***C21D 1/26*** | (2006.01) |
| ***C23C 2/02*** | (2006.01) |
| ***C21D 8/02*** | (2006.01) |
| ***C23C 2/06*** | (2006.01) |
| ***C23C 2/28*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C23C 2/02* (2013.01); *C21D 8/0226* (2013.01); *C21D 8/0236* (2013.01); *C21D 8/0273* (2013.01); *C23C 2/06* (2013.01); *C23C 2/28* (2013.01); *C22C 38/002* (2013.01); *C22C 38/02* (2013.01); *C22C 38/04* (2013.01); *C22C 38/06* (2013.01); *C21D 8/0263* (2013.01)

USPC ..... 148/533; 148/400

(58) Field of Classification Search

CPC .. C21D 8/0226; C21D 8/0236; C21D 8/0263; C22C 38/002

USPC ..... 148/533, 400

See application file for complete search history.

(56) References Cited

U.S. PATENT DOCUMENTS

| | | | | |
|---|---|---|---|---|
| 6,638,371 | B1 * | 10/2003 | Mochida et al. | 148/320 |
| 7,754,030 | B2 * | 7/2010 | Okitsu | 148/320 |
| 8,076,008 | B2 * | 12/2011 | Kaneko et al. | 428/659 |
| 8,460,481 | B2 * | 6/2013 | Azuma et al. | 148/320 |
| 2003/0201039 | A1 | 10/2003 | Mochida et al. | |
| 2008/0075971 | A1 | 3/2008 | Sun | |

FOREIGN PATENT DOCUMENTS

| | | | |
|---|---|---|---|
| EP | 1096029 | A1 | 5/2001 |
| EP | 1486574 | A1 | 12/2004 |
| JP | 06-093340 | A | 4/1994 |
| JP | 11-279691 | A | 10/1999 |
| JP | 11-293396 | | 10/1999 |
| JP | 2008-291304 | A | 12/1999 |
| JP | 2000-144261 | A | 5/2000 |
| JP | 2002-256386 | A | 9/2002 |
| JP | 2004-250774 | A | 9/2004 |
| JP | 2006-265671 | A | 10/2006 |
| JP | 2008-101237 | A | 5/2008 |
| JP | 2008-231480 | A | 10/2008 |
| WO | WO2008/123561 | A1 | 10/2008 |
| WO | WO 2009/054539 | A1 | 4/2009 |

OTHER PUBLICATIONS

International Search Report for International Application No. PCT/JP2010/003780 dated Sep. 7, 2010.
International Preliminary Report and Written Opinion for PCT/JP2010/003780 dated Jan. 17, 2012.
Supplementary European Search Report dated Feb. 14, 2013, application No. EP10789180.

* cited by examiner

*Primary Examiner* — Jie Yang
(74) *Attorney, Agent, or Firm* — RatnerPrestia

(57) ABSTRACT

The present invention provides a high-strength galvanized steel sheet having excellent ductility, stretch flangeability, and fatigue resistance, and a method for manufacturing the same. A high-strength galvannealed steel sheet having excellent formability and fatigue resistance is characterized in that the steel sheet is composed of steel having a composition containing, by % by mass, C: 0.05% to 0.3%, Si: 0.5% to 2.5%, Mn: 1.0% to 3.5%, P: 0.003% to 0.100%, S: 0.02% or less, Al: 0.010% to 0.1%, and the balance including iron and unavoidable impurities, and the steel sheet has a microstructure containing 50% or more of ferrite, 5% to 35% of martensite, and 2% to 15% of pearlite in terms of an area ratio, the martensite having an average gain size of 3 μm or less and an average distance of 5 μm or less between adjacent martensite grains.

10 Claims, No Drawings

HIGH-STRENGTH GALVANNEALED STEEL SHEET HAVING EXCELLENT FORMABILITY AND FATIGUE RESISTANCE AND METHOD FOR MANUFACTURING THE SAME

CROSS REFERENCE TO RELATED APPLICATION

This application is the U.S. National Phase application of PCT International Application No. PCT/JP2010/003780, filed Jun. 7, 2010, and claims priority to Japanese Patent Application No. 2009-144075, filed Jun. 17, 2009, the disclosure of both are incorporated herein by reference in their entireties for all purposes.

FIELD OF THE INVENTION

The present invention relates to a high-strength galvanized steel sheet having excellent formability and fatigue resistance for members used in the automobile industrial field, and a method for manufacturing the steel sheet.

BACKGROUND OF THE INVENTION

In recent years, improvement in fuel consumption of automobiles has become an important problem from the viewpoint of global environment conservation. Therefore, there has been an active movement for thinning car body materials by increasing the strength thereof, thereby lightening the weights of car bodies. However, an increase in strength of steel sheets causes a decrease in elongation, i.e., a decrease in formability, and thus development of materials having both high strength and high formability is demanded.

Further, in consideration of recent increases in demands for improvement of corrosion resistance of automobiles, high-strength galvanized steel sheets have been increasingly developed.

For these demands, various multi-phase-type high-strength galvanized steel sheets, such as ferrite-martensite two-phase steel (DP steel) and TRIP steel using the transformation-induced plasticity of retained austenite, have been developed so far.

For example, Patent Literature 1 proposes a galvannealed steel sheet with excellent formability which contains a large amount of Si added to secure retained austenite and achieve high ductility.

However, the DP steel and the TRIP steel have excellent elongation properties but have the problem of poor stretch flangeability. The stretch flangeability is an index which indicates formability (stretch flangeability) in forming a flange by expanding a formed hole and is an important characteristic, together with elongation, required for high-strength steel sheets.

As a method for manufacturing a galvanized steel sheet having excellent stretch flangeability, Patent Literature 2 discloses a technique for improving stretch flangeability by reheating martensite to produce tempered martensite, the martensite being produced by annealing and soaking and then strongly cooling to a Ms point during the time to a galvanization bath. Although the stretch flangeability is improved by converting martensite to tempered martensite, low EL becomes a problem.

Further, as a performance of press-formed parts, the parts include portions required to have fatigue resistance, and thus it is necessary to improve the fatigue resistance of materials.

In this way, high-strength galvanized steel sheets are required to have excellent elongation, stretch flangeability, and fatigue resistance. However, conventional galvanized steel sheets do not have high levels of all these characteristics.

CITATION LIST

Patent Literature

PTL 1: Japanese Unexamined Patent Application Publication No. 11-279691

PTL 2: Japanese Unexamined Patent Application Publication No. 6-93340

SUMMARY OF INVENTION

The present invention provides a high-strength galvanized steel sheet having excellent ductility, stretch flangeability, and fatigue resistance, and a method for manufacturing the steel sheet.

The inventors of the present invention repeated keen research for manufacturing a high-strength galvanized steel sheet having excellent ductility, stretch flangeability, and fatigue resistance from the viewpoint of the composition and microstructure of the steel sheet. As a result, it was found that in order to improve stretch flangeability and fatigue resistance, it is effective to uniformly finely disperse an appropriate amount of martensite in a final microstructure by appropriately controlling alloy elements to produce a hot-rolled sheet having a microstructure mainly composed of bainite and martensite, cold-rolling the hot-rolled sheet used as a material, and then rapidly heating the sheet at 8° C./s or more in an annealing process. It was further found that coating is performed, and then coating-alloying is performed in a temperature region of 540° C. to 600° C. to produce an appropriate amount of pearlite, thereby suppressing a decrease in stretch flangeability due to martensite.

The present invention is configured on the basis of the above findings.

That is, embodiments of the present invention include:

(1) A high-strength galvannealed steel sheet having excellent formability and fatigue resistance, characterized in that the steel sheet is composed of steel having a composition containing, by % by mass, C: 0.05% to 0.3%, Si: 0.5% to 2.5%, Mn: 1.0% to 3.5%, P: 0.003% to 0.100%, S: 0.02% or less, Al: 0.010% to 0.1%, and the balance including iron and unavoidable impurities, and the steel sheet has a microstructure containing 50% or more of ferrite, 5% to 35% of martensite, and 2% to 15% of pearlite in terms of an area ratio, the martensite having an average gain size of 3 μm or less and an average distance of 5 μm or less between adjacent martensite grains.

(2) The high-strength galvannealed steel sheet having excellent formability and fatigue resistance described above in (1), characterized in that the microstructure of the steel sheet described above in (1) further contains 5% to 20% of bainite and/or 2% to 15% of retrained austenite in terms of an area ratio.

(3) The high-strength galvannealed steel sheet having excellent formability and fatigue resistance described above in (1) or (2), characterized in that the steel described above in (1) or (2) further contains, by % by mass, at least one element selected from Cr: 0.005% to 2.00%, Mo: 0.005% to 2.00%, V: 0.005% to 2.00%, Ni: 0.005% to 2.00%, and Cu: 0.005% to 2.00%.

(4) The high-strength galvannealed steel sheet having excellent formability and fatigue resistance described above in any one of (1) to (3), characterized in that the steel described above in (1) to (3) further contains, by % by mass, at least one element selected from Ti: 0.01% to 0.20% and Nb: 0.01% to 0.20%.

(5) The high-strength galvannealed steel sheet having excellent formability and fatigue resistance described above in any one of (1) to (4), characterized in that the steel described above in (1) to (4) further contains, by % by mass, B: 0.0002% to 0.005%.

(6) The high-strength galvannealed steel sheet having excellent formability and fatigue resistance described above in any one of (1) to (5), characterized in that the steel described above in (1) to (5) further contains, by % by mass, one or two elements selected from Ca: 0.001% to 0.005% and REM: 0.001% to 0.005%.

(7) A method for manufacturing a high-strength galvannealed steel sheet having excellent formability and fatigue resistance, characterized by hot-rolling a slab containing the components described above in any one of (1) to (6) to produce a hot-rolled steel sheet having a microstructure in which a total area ratio of bainite and martensite is 80% or more; cold-rolling the hot-rolled sheet to produce a cold-rolled steel sheet; continuously annealing the cold-rolled steel sheet by heating to 750° C. to 900° C. at an average heating rate of 8° C./s or more from 500° C. to an $A_1$ transformation point, holding the steel sheet for 10 seconds or more, and then cooling the steel sheet to a temperature region of 300° C. to 530° C. at an average cooling rate of 3° C./s or more from 750° C. to 530° C.; galvanizing the steel sheet; and further coating-alloying the steel sheet for 5 to 60 seconds in a temperature region of 540° C. to 600° C.

(8) A method for manufacturing a high-strength galvannealed steel sheet having excellent formability and fatigue resistance, characterized by hot-rolling a slab containing the components described above in any one of (1) to (6) to produce a hot-rolled sheet having a microstructure in which a total area ratio of bainite and martensite is 80% or more; cold-rolling the hot-rolled sheet to produce a cold-rolled steel sheet; continuously annealing the cold-rolled steel sheet by heating to 750° C. to 900° C. at an average heating rate of 8° C./s or more from 500° C. to an $A_1$ transformation point, holding the steel sheet for 10 seconds or more, cooling the steel sheet to a temperature region of 300° C. to 530° C. at an average cooling rate of 3° C./s or more from 750° C. to 530° C., and then holding the steel sheet in a temperature region of 300° C. to 530° C. for 20 to 900 seconds; galvanizing the steel sheet; and further coating-alloying the steel sheet for 5 to 60 seconds in a temperature region of 540° C. to 600° C.

(9) A method for manufacturing a high-strength galvannealed steel sheet having excellent formability and fatigue resistance, characterized by hot-rolling, in a hot-rolling step, a slab containing the components described above in any one of (1) to (6) at a finish rolling temperature equal to or higher than an $A_3$ transformation point, cooling at an average cooling rate of 50° C./s or more, and then coiling at a temperature of 300° C. or more and 550° C. or less to produce a hot-rolled sheet; cold-rolling the hot-rolled sheet to produce a cold-rolled steel sheet; continuously annealing the cold-rolled steel sheet by heating to 750° C. to 900° C. at an average heating rate of 8° C./s or more from 500° C. to an $A_1$ transformation point, holding the steel sheet for 10 seconds or more, and then cooling the steel sheet to a temperature region of 300° C. to 530° C. at an average cooling rate of 3° C./s or more from 750° C. to 530° C.; galvanizing the steel sheet; and further coating-alloying the steel sheet in a temperature region of 540° C. to 600° C. for 5 to 60 seconds.

(10) A method for manufacturing a high-strength galvannealed steel sheet having excellent formability and fatigue resistance, characterized by hot-rolling, in a hot-rolling step, a slab containing the components described above in any one of (1) to (6) at a finish rolling temperature equal to or higher than an $A_3$ transformation point, cooling at an average cooling rate of 50° C./s or more, and then coiling at a temperature of 300° C. or more and 550° C. or less to produce a hot-rolled sheet; cold-rolling the hot-rolled sheet to produce a cold-rolled steel sheet; continuously annealing the cold-rolled sheet by heating to 750° C. to 900° C. at an average heating rate of 8° C./s or more from 500° C. to an $A_1$ transformation point, holding the steel sheet for 10 seconds or more, cooling the steel sheet to a temperature region of 300° C. to 530° C. at an average cooling rate of 3° C./s or more from 750° C. to 530° C., and then holding the steel sheet for 20 to 900 seconds in a temperature region of 300° C. to 530° C.; galvanizing the steel sheet; and further coating-alloying the steel sheet in a temperature region of 540° C. to 600° C. for 5 to 60 seconds.

The present invention exhibits the effect that a high-strength galvanized steel sheet having excellent formability and fatigue resistance can be obtained, and thus both weight lightening and improvement in crash safety of automobiles can be realized, thereby significantly contributing to higher performance of automobile car bodies.

DETAILED DESCRIPTION OF THE INVENTION

Aspects of the present invention are described in detail below.

First, the reasons for limiting a composition of steel to the above-described ranges in the present invention are described. In addition, the indication "%" for each of the components represents "% by mass" unless otherwise specified.

C: 0.05% to 0.3%

C is an element necessary for increasing the strength of a steel sheet by producing a low-temperature transformation phase such as martensite and for improving TS-EL balance by making a multi-phase microstructure. At a C content less than 0.05%, it is difficult to secure 5% or more of martensite even by optimizing the production conditions, thereby decreasing strength and TS×EL. On the other hand, at a C content exceeding 0.3%, a weld zone and a heat-affected zone are significantly hardened, and thus the mechanical properties of the weld zone are degraded. From this viewpoint, the C content is controlled to the range of 0.05% to 0.3%, and preferably 0.08% to 0.14%.

Si: 0.5% to 2.5%

Si is an element effective for hardening steel and is particularly effective for hardening ferrite by solution hardening. Since fatigue cracks occur in multi-phase steel due to soft ferrite, hardening of ferrite by Si addition is effective for suppressing the occurrence of fatigue cracks. In addition, Si is a ferrite producing element and easily forms a multi-phase of ferrite and a second phase. Here, the lower limit of the Si content is 0.5% because addition of Si at a content of less than 0.5% exhibits an insufficient effect. However, excessive addition of Si causes deterioration in ductility, surface quality, and weldability, and thus S is added at 2.5% or less, preferably 0.7% to 2.0%.

Mn: 1.0% to 3.5%

Mn is an element effective for hardening steel and promotes the production of a low-temperature transformation phase. This function is recognized at a Mn content of 1.0% or more. However, the excessive addition of over 3.5% of Mn causes significant deterioration in ductility of ferrite due to an excessive increase in a low-temperature transformation phase and solution hardening, thereby decreasing formability. Therefore, the Mn content is 1.0% to 3.5%, preferably 1.5% to 3.0%.

P: 0.003% to 0.100%

P is an element effective for hardening steel, and this effect is achieved at 0.003% or more. However, the excessive addition of over 0.100% of P induces embrittlement due to grain boundary segregation, degrading crash worthiness. Therefore, the P content is 0.003% to 0.100%.

S: 0.02% or less

S forms an inclusion such as MnS and causes deterioration in crash worthiness and a crack along a metal flow in a weld zone. Therefore, the S content is preferably as low as possible, but is 0.02% or less from the viewpoint of manufacturing cost.

Al: 0.010% to 0.1%

Al functions as a deoxidizing agent and is an element effective for cleanliness of steel, and is preferably added in a deoxidizing step. At an Al content of less than 0.010%, the effect of Al addition becomes insufficient, and thus the lower limit is 0.010%. However, the excessive addition of Al results in deterioration in surface quality due to deterioration in slab quality at the time of steel making. Therefore, the upper limit of the amount of Al added is 0.1%.

The high-strength galvanized steel sheet of the present invention has the above-described composition as a basic composition and the balance including iron and unavoidable impurities. However, components described below can be appropriately added according to desired characteristics.

At least one selected from Cr: 0.005% to 2.00%, Mo: 0.005% to 2.00%, V: 0.005% to 2.00%, Ni: 0.005% to 2.00%, and Cu: 0.005% to 2.00%

Cr, Mo, V, Ni, and Cu promote the formation of a low-temperature transformation phase and effectively function to harden steel. This effect is achieved by adding 0.005% or more of at least one of Cr, Mo, V, Ni, and Cu. However, when the content of one of Mo, V, Ni, and Cu exceeds 2.00%, the effect is saturated, thereby increasing the cost. Therefore, the content of one of Mo, V, Ni, and Cu is 0.005% to 2.00%.

One or two of Ti: 0.01% to 0.20% and Nb: 0.01% to 0.20%

Ti and Nb form carbonitrides and have the function of strengthening steel by precipitation strengthening. This effect is recognized at 0.01% or more. On the other hand, even when over 0.20% of one of Ti and Nb is added, excessive strengthening occurs, decreasing ductility. Therefore, the content of one of Ti and Nb is 0.01% to 0.20%.

B: 0.0002% to 0.005%

B has the function of suppressing the production of ferrite from austenite grain boundaries and increasing strength. This effect is achieved at 0.0002% or more. However, at a B content exceeding 0.005%, the effect is saturated, thereby increasing the cost. Therefore, the B content is 0.0002% to 0.005%.

One or two selected from Ca: 0.001% to 0.005% and REM: 0.001% to 0.005%

Both Ca and REM have the effect of improving formability by controlling the forms of sulfides, and 0.001% or more of one or two of Ca and REM can be added according to demand. However, excessive addition may adversely affect cleanliness, and thus the content of one of Ca and REM is 0.005% or less.

Next, the microstructure of steel is described.

<<Final Microstructure>>

Ferrite area ratio: 50% or more

The ferrite area ratio is 50% or more because when the ferrite area ratio is less than 50%, a balance between TS and EL is degraded.

Martensite area ratio: 5% to 35%

A martensitic phase effectively functions to strengthen steel. In addition, a multi-phase with ferrite decreases the yield ratio and increases the work hardening rate at the time of deformation, and is also effective in improving TS×EL. Further, martensite functions as a barrier to the progress of fatigue cracking and thus effectively functions to improve fatigue properties. At an area ratio of less than 5%, these effects are insufficient, while at an excessive area ratio exceeding 35%, elongation and stretch flangeability are significantly degraded even in the coexistence with 2% to 15% of pearlite as described below. Therefore, the area ratio of a martensitic phase is 5% to 35%.

Pearlite Area ratio: 2% to 15%

Pearlite has the effect of suppressing a decrease in stretch flangeability due to martensite. Martensite is very harder than ferrite and has a large difference in hardness, thereby decreasing stretch flangeability. However, the coexistence of martensite with pearlite can suppress a decrease in stretch flangeability due to martensite. Although details of the suppression of a decrease in stretch flangeability by pearlite are unknown, the suppression is considered to be due to the fact that a difference in hardness is reduced by the presence of a pearlitic phase having intermediate hardness between ferrite and martensite. At an area ratio of less than 2%, the above effect is insufficient, while at an excessive area ratio exceeding 15%, TS×EL is decreased. Therefore, the pearlite area ratio is 2% to 15%.

The high-strength galvanized steel sheet of the present invention has the above-described microstructure as a basic microstructure, but may appropriately contain microstructures described below according to desired characteristics.

Bainite area ratio: 5% to 20%

Like martensite, bainite effectively functions to increase the strength of steel and improve fatigue properties of steel. At an area ratio of less than 5%, the above effect is insufficient, while at an excessive area ratio exceeding 20%, Ts×EL is decreased. Therefore, the area ratio of a bainitic phase is 5% to 20%.

Retained austenite area ratio: 2% to 15%

Retained austenite not only contributes to strengthening of steel but also effectively functions to improve Ts×EL by the TRIP effect. This effect can be achieved at an area ratio of 2% or more. In addition, when the area ratio of retained austenite exceeds 15%, stretch flangeability and fatigue resistance are significantly degraded. Therefore, the area ratio of a retained austenite phase is 2% or more and 15% or less.

Average grain size of martensite: 3 μm or less, average distance between adjacent martensite grains: 5 μm or less The stretch flangeability and fatigue resistance are improved by uniformly finely dispersing martensite. This effect becomes significant when the average grain size of martensite is 3 μm or less, and the average distance between adjacent martensite grains is 5 μm or less. Therefore, the average grain size of martensite is 3 μm or less, and the average distance between adjacent martensite grains is 5 μm or less.

Next, the manufacturing conditions are described.

Steel adjusted to have the above-described composition is melted in a converter and formed into a slab by a continuous casting method or the like. The steel is hot-rolled to produce a hot-rolled steel sheet, further cold-rolled to produce a cold-rolled steel sheet, continuously annealed, and then galvanized and coating-alloyed.

<<Hot-Rolling Conditions>>

Finish rolling temperature: $A_3$ transformation point or more, average cooling rate: 50° C./s or more In hot-rolling at a finish rolling end temperature of less than the $A_3$ point or an average cooling rate of less than 50° C./s, ferrite is excessively produced during rolling or cooling, thereby making it difficult to form a hot-rolled sheet microstructure containing bainite and martensite at a total area ratio of 80% or more. Therefore, the finish rolling temperature is the $A_3$ transformation point or more, and the average cooling rate is 50° C./s or more.

Coiling temperature: 300° C. or more and 550° C. or less

At a coiling temperature exceeding 550° C., ferrite and pearlite are produced after coiling, thereby making it difficult to form a hot-rolled sheet microstructure containing bainite and martensite at a total area ratio of 80% or more. At a coiling temperature of less than 300° C., the shape of the hot-rolled sheet is worsened, or the strength of the hot-rolled sheet is excessively increased to cause difficulty in cold-rolling. Therefore, the coiling temperature is 300° C. or more and 550° C. or less.

<<Hot-Rolled Sheet Microstructure>>

Total area ratio of bainite and martensite: 80% or more

In cold-rolling and annealing the hot-rolled sheet, austenite is produced by heating to the $A_1$ transformation point or more. In particular, austenite is preferentially produced at bainite and martensite positions in the hot-rolled sheet microstructure, and thus austenite is uniformly and finely dispersed in the hot-rolled sheet having a microstructure mainly composed of martensite and bainite. Austenite produced by annealing is converted to a low-temperature transformation phase such as martensite by subsequent cooling. Therefore, when the hot-rolled sheet microstructure contains bainite and martensite at a total area ratio of 80% or more, a final steel sheet can be produced to have a microstructure in which a martensite average grain size is 3 μm or less and an average distance between adjacent martensite grains is 5 μm or less. Therefore, the total area ratio of bainite and martensite in the hot-rolled sheet is 80% or more.

<<Continuous Annealing Conditions>>

Average heating rate from 500° C. to $A_1$ transformation point: 8° C./s or more When the average heating rate in a recrystallization temperature region of 500° C. to an $A_1$ transformation point in the steel of the present invention is 8° C./s or more, recrystallization is suppressed during heating, thereby effectively affecting refining of austenite produced at a temperature equal to or higher than the $A_1$ transformation point and, consequently, refining of martensite after annealing and cooling. At an average heating rate of less than 8° C./s, α-phase is recrystallized during heating, and thus strain introduced into the α-phase is released, failing to achieve sufficient refining. Therefore, the average heating rate from 500° C. to the $A_1$ transformation point is 8° C./s or more.

Heating condition: holding at 750° C. to 900° C. for 10 seconds or more

With a heating temperature of less than 750° C. or a holding time of less than 10 seconds, austenite is not sufficiently produced during annealing, and thus a sufficient amount of low-temperature transformation phase cannot be secured after annealing and cooling. In addition, at a heating temperature exceeding 990° C., it is difficult to secure 50% or more of ferrite in the final microstructure. Although the upper limit of the holding time is not particularly limited, a holding time of 600 seconds or more leads to saturation of the effect and an increase in cost. Therefore, the holding time is preferably less than 600 seconds.

Average cooling rate from 750° C. to 530° C.: 3° C./s or more

At an average cooling rate from 750° C. to 530° C. of less than 3° C./s, pearlite is excessively produced, thereby decreasing TS×EL. Therefore, the average cooling rate from 750° C. to 530° C. is 3° C./s or more. Although the upper limit of the cooling rate is not particularly limited, an excessively high cooling rate leads to worsening of the shape of the steel sheet and difficulty in controlling the ultimate cooling temperature. Therefore, the cooling rate is preferably 200° C./s or less.

Cooling stop temperature: 300° C. to 530° C. At a cooling stop temperature of less than 300° C., austenite is transformed to martensite, and thus pearlite cannot be produced even by subsequent re-heating. At a cooling stop temperature exceeding 530° C., pearlite is excessively produced, thereby decreasing TS×EL.

Holding conditions after stop of cooling: in a temperature region of 300° C. to 530° C. for 20 to 900 seconds Bainite transformation proceeds by holding in the temperature region of 300° C. to 530° C. In addition, C is concentrated in untransformed austenite with the bainite transformation, and thus retained austenite can be secured. In order to produce a microstructure containing bainite and/or retained austenite, holding is performed in the temperature region of 300° C. to 530° C. for 20 to 900 seconds after cooling. With a holding temperature of less than 300° C. or a holding time of less than 20 seconds, bainite and retained austenite are not sufficiently produced. With a holding temperature exceeding 530° C. or a holding time exceeding 900 seconds, pearlite transformation and bainite transformation excessively proceed, and thus a desired amount of martensite cannot be secured. Therefore, holding after cooling is performed in the temperature region of 300° C. to 530° C. for 20 to 900 seconds.

After the above-described annealing is performed, galvanization and coating-alloying are performed.

Alloying conditions: 540° C. to 600° C. for 5 to 60 seconds

With an alloying temperature of less than 540° C. or an alloying time of less than 5 seconds, substantially no pearlite transformation occurs, and thus 2% or more of pearlite cannot be produced. While with an alloying temperature exceeding 600° C. or an alloying time exceeding 60 seconds, pearlite is excessively produced, thereby decreasing TS×EL. Therefore, the alloying conditions include 540° C. to 600° C. and 5 to 60 seconds.

When the temperature of the sheet immersed in a coating bath is lower than 430° C., zinc adhering to the steel sheet may be solidified. Therefore, when the stop temperature of rapid cooling and the holding temperature after the stop of rapid cooling are lower than the temperature of the coating bath, the steel sheet is preferably heated before being immersed in the coating bath. Of course, if required, wiping may be performed for adjusting the coating weight after coating.

In addition, the steel sheet after galvanization (steel sheet after alloying) may be temper-rolled for correcting the shape, adjusting the surface roughness, etc. Further, treatment such as oil and fat coating or any one of various types of coatings may be performed without disadvantage.

The other conditions for manufacture are not particularly limited, but preferred examples are described below.

Casting Conditions:

The steel slab used is preferably produced by a continuous casting method in order to prevent macro segregation of components, but the slab may be produced by an ingot-making method or a thin-slab casting method. In addition, after the steel slab is produced, the steel slab may be cooled to room temperature and then reheated without any problem according to a conventional method, or the steel slab may be subjected to an energy-saving process such as a direct rolling process in which without being cooled to room temperature, the steel slab is inserted as a hot slab into a heating furnace or is immediately rolled after slightly warmed.

Hot-Rolling Conditions:

Slab heating temperature: 1100° C. or more

The slab heating temperature is preferably a low-heating temperature from the viewpoint of energy, but at a heating temperature of less than 1100° C., there occurs the problem of causing insufficient dissolution of carbides or increasing the possibility of occurrence of a trouble due to an increase in rolling load during hot-rolling. In addition, in view of an increase in scale loss with an increase in oxide weight, the slab heating temperature is preferably 1300° C. or less. From the viewpoint that a trouble in hot-rolling is prevented even at a lower slab heating temperature, a so-called sheet bar heater configured to heat a sheet bar may be utilized.

In the hot-rolling step in an embodiment of the present invention, part or the whole of finish rolling may be replaced by lubrication rolling in order to decrease the rolling load during hot rolling. The lubrication rolling is effective from the viewpoint of uniform shape and uniform material of the steel sheet. The friction coefficient in the lubrication rolling is preferably in the range of 0.25 to 0.10. Also, a continuous rolling process is preferred, in which adjacent sheet bars are bonded to each other and continuously finish-rolled. From the viewpoint of operation stability of hot-rolling, it is preferred to apply the continuous rolling process.

In subsequent cold-rolling, preferably, oxidized scales on the surface of the hot-rolled steel sheet are removed by pickling and then subjected to cold rolling to produce a hold-rolled steel sheet having a predetermined thickness. The pickling conditions and the cold-rolling conditions are not particularly limited but may comply with a usual method. The reduction ratio of cold rolling is preferably 40% or more.

EXAMPLES

Steel having each of the compositions shown in Table 1 and the balance composed of Fe and unavoidable impurities was melted in a converter and formed into a slab by a continuous casting method. The resultant cast slab was hot-rolled to a thickness of 2.8 mm under the conditions shown in Table 2. Then, the hot-rolled sheet was pickled and then cold-rolled to a thickness of 1.4 mm to produce a cold-rolled steel sheet, which was then subjected to annealing.

Next, in a continuous galvanizing line, the cold-rolled steel sheet was annealed under the conditions shown in Table 2, galvanized at 460° C., alloyed, and then cooled at an average cooling rate of 10° C./s. The coating weight per side was 35 to 45 g/m$^2$.

TABLE 1

| | Chemical composition (mass %) | | | | | | | | | |
|---|---|---|---|---|---|---|---|---|---|---|
| Steel | C | Si | Mn | P | S | AL | Cr, Mo, V, Ni, Cu | Ti, Nb, B | Ca, REM | Remarks |
| A | 0.12 | 1.2 | 2.0 | 0.010 | 0.0050 | 0.03 | — | | — | Invention steel |
| B | 0.16 | 1.5 | 1.2 | 0.010 | 0.0025 | 0.04 | Cr: 0.5 | | — | Invention steel |
| C | 0.08 | 1.0 | 2.0 | 0.009 | 0.0041 | 0.03 | Mo: 0.3 | | | Invention steel |
| D | 0.14 | 2.0 | 1.2 | 0.008 | 0.0028 | 0.05 | V: 0.03 | | | Invention steel |
| E | 0.07 | 1.0 | 1.6 | 0.012 | 0.0014 | 0.03 | Ni: 0.2, Cu: 0.4 | | | Invention steel |
| F | 0.09 | 1.5 | 2.9 | 0.012 | 0.0014 | 0.02 | | Ti: 0.03 | | Invention steel |
| G | 0.11 | 0.7 | 2.3 | 0.009 | 0.0008 | 0.04 | | Nb: 0.02 | | Invention steel |
| H | 0.08 | 1.2 | 1.9 | 0.012 | 0.0035 | 0.05 | | B: 0.002 | | Invention steel |
| I | 0.20 | 1.8 | 2.1 | 0.012 | 0.0020 | 0.04 | | | Ca: 0.002, REM: 0.003 | Invention steel |
| J | 0.03 | 1.3 | 1.8 | 0.012 | 0.0035 | 0.03 | | | | Comparative steel |
| K | 0.07 | 0.3 | 1.3 | 0.014 | 0.0013 | 0.03 | | | | Comparative steel |
| L | 0.11 | 1.0 | 0.5 | 0.010 | 0.0015 | 0.03 | | | | Comparative steel |
| M | 0.14 | 1.3 | 4.0 | 0.012 | 0.0015 | 0.03 | | | | Comparative steel |

TABLE 2

| | | | | Hot-rolling conditions | | | Continuous galvanization conditions | | | | | | | | |
|---|---|---|---|---|---|---|---|---|---|---|---|---|---|---|---|
| Steel sheet | Steel | $A_1$ point (° C.) | $A_3$ point (° C.) | Finish rolling temperature (° C.) | Cooling rate (° C./s) | Coiling temperature (° C.) | Average heating rate from 500° C.~A1 (° C./s) | Annealing temperature (° C.) | Annealing time (sec) | Cooling rate (° C./s) | Cooling stop temperature (° C.) | Low-temperature holding time (sec) | Alloying temperature (° C.) | Alloying time(s) | Remarks |
| 1 | A | 724 | 881 | 900 | 100 | 450 | 15 | 850 | 60 | 12 | 500 | — | 560 | 20 | Invention example |
| 2 | | | | 900 | 100 | 450 | 15 | 850 | 60 | 12 | 400 | 120 | 560 | 20 | Invention example |
| 3 | | | | 840 | 80 | 480 | 15 | 830 | 60 | 12 | 420 | 120 | 560 | 20 | Comparative example |
| 4 | B | 749 | 901 | 920 | 100 | 500 | 20 | 830 | 60 | 15 | 490 | — | 550 | 15 | Invention example |
| 5 | | | | 920 | 100 | 450 | 20 | 830 | 120 | 15 | 450 | 60 | 550 | 15 | Invention example |
| 6 | | | | 920 | 20 | 500 | 20 | 830 | 120 | 15 | 450 | 60 | 550 | 15 | Comparative example |
| 7 | | | | 920 | 100 | 600 | 20 | 850 | 60 | 15 | 450 | 60 | 550 | 15 | Comparative example |
| 8 | | | | 920 | 100 | 450 | 5 | 850 | 60 | 15 | 400 | 60 | 550 | 15 | Comparative example |
| 9 | C | 730 | 883 | 890 | 80 | 400 | 15 | 800 | 90 | 30 | 500 | 25 | 580 | 10 | Invention example |
| 10 | | | | 890 | 80 | 400 | 15 | 800 | 90 | 30 | 450 | 240 | 580 | 10 | Invention example |
| 11 | | | | 890 | 80 | 400 | 15 | 950 | 120 | 30 | 420 | 120 | 580 | 10 | Comparative example |
| 12 | | | | 890 | 80 | 400 | 15 | 700 | 120 | 30 | 450 | 120 | 580 | 10 | Comparative example |
| 13 | | | | 890 | 80 | 400 | 15 | 800 | 5 | 30 | 450 | 120 | 580 | 10 | Comparative example |
| 14 | D | 749 | 844 | 870 | 200 | 450 | 20 | 800 | 90 | 20 | 420 | 60 | 550 | 7 | Invention example |
| 15 | | | | 870 | 200 | 450 | 20 | 800 | 90 | 2 | 420 | 60 | 550 | 7 | Comparative example |
| 16 | E | 725 | 888 | 900 | 150 | 450 | 10 | 870 | 20 | 60 | 440 | 220 | 570 | 20 | Invention example |
| 17 | | | | 900 | 150 | 450 | 10 | 870 | 20 | 60 | 250 | 120 | 570 | 20 | Comparative example |
| 18 | | | | 900 | 150 | 450 | 10 | 870 | 20 | 60 | 550 | 120 | 570 | 20 | Comparative example |
| 19 | | | | 900 | 150 | 450 | 10 | 870 | 20 | 10 | 480 | 1000 | 570 | 20 | Comparative example |
| 20 | | | | 900 | 150 | 450 | 10 | 870 | 20 | 10 | 480 | 120 | 620 | 20 | Comparative example |
| 21 | | | | 900 | 150 | 450 | 10 | 870 | 20 | 10 | 480 | 120 | 520 | 20 | Comparative example |
| 22 | F | 719 | 874 | 890 | 70 | 500 | 15 | 830 | 60 | 10 | 450 | 600 | 590 | 20 | Invention example |
| 23 | G | 711 | 846 | 860 | 100 | 500 | 30 | 800 | 60 | 10 | 450 | 120 | 560 | 15 | Invention example |
| 24 | H | 726 | 894 | 900 | 100 | 330 | 20 | 830 | 90 | 15 | 350 | 240 | 570 | 20 | Invention example |
| 25 | I | 732 | 887 | 900 | 150 | 520 | 15 | 870 | 60 | 20 | 400 | 120 | 560 | 50 | Invention example |
| 26 | J | 730 | 916 | 920 | 150 | 450 | 20 | 850 | 60 | 20 | 450 | 60 | 570 | 20 | Comparative example |
| 27 | K | 716 | 866 | 880 | 100 | 500 | 15 | 820 | 90 | 20 | 400 | 150 | 560 | 30 | Comparative example |
| 28 | L | 740 | 923 | 930 | 150 | 520 | 20 | 870 | 120 | 20 | 420 | 40 | 570 | 20 | Comparative example |
| 29 | M | 700 | 815 | 850 | 100 | 500 | 15 | 780 | 120 | 10 | 470 | 60 | 560 | 15 | Comparative example |
| 30 | E | 725 | 888 | 900 | 150 | 450 | 10 | 870 | 20 | 10 | 480 | 120 | 580 | 100 | Comparative example |

The sectional microstructure, tensile properties, and stretch flangeability of each of the resultant steel sheets were examined. The results are shown in Table 3. The sectional microstructure of each steel sheet was examined by exposing a microstructure with a 3% nital solution (3% nitric acid+ethanol) and observing at a ¼ thickness in the depth direction with a scanning electron microscope. In a photograph of the microstructure, the area ratio of a ferritic phase was determined by image analysis (which can be performed using a commercial image processing software). The martensite area ratio, the pearlite area ratio, and the bainite area ratio were determined from a SEM photograph with a proper magnification of ×1000 to ×5000 according to the fineness of the microstructure using an image processing software.

With respect to the martensite average gain size, the area of martensite in a field of view observed with a scanning electron microscope at 5000 times was divided by the number of martensite grains to determine an average area, and the ½ power of the average area was regarded as the average gain size. In addition, the average distance between adjacent martensite grains was determined as follows. First, the distances from a randomly selected point in a randomly selected martensite grain to the closest grain boundaries of other martensite grains present around the randomly selected martensite grain were determined. An average of the three shortest distances among the distances was regarded as the near distance of martensite. Similarly, the near distances of a total of 15 martensite grains were determined, and an average of 15 near distances was regarded as the average distance between adjacent martensite grains.

The steel sheet was polished to a surface at ¼ in the thickness direction, and the area ratio of retained austenite was determined from the intensity of diffracted X-rays of the surface at the ¼ thickness of the steel sheet. CoKα rays were used as incident X rays, and intensity ratios of all combinations of integral intensity peaks of [111], [200], and [311] planes of the retained austenite phase, and [110], [200], and [211] planes of the ferrite phase were determined. An average of these intensity ratios was considered as the area ratio of the retained austenite.

The tensile properties were determined by a tensile test using a JIS No. 5 test piece obtained from the steel sheet so that the tensile direction was perpendicular to the rolling direction according to JIS Z2241. Tensile strength (TS) and elongation (EL) were measured, and a strength-elongation balance value represented by the product (TS×EL) of strength and elongation was determined.

The stretch flangeability was evaluated from a hole expansion ratio (λ) determined by a hole expansion test according to Japan Iron & Steel Federation standards JFST 1001.

The fatigue resistance was evaluated from an endurance ratio (FL/TS) which was the ratio of fatigue limit (FL) to tensile strength (TS), the fatigue limit being determined by a plane bending fatigue test method.

The test piece used in the fatigue test had a shape with an R of 30.4 mm in a stress loading portion and a minimum width of 20 mm. In the test, a load was applied in a cantilever manner with a frequency of 20 Hz and a stress ratio −1, and the stress at which the number of repetitions exceeded $10^6$ was considered as the fatigue limit (FL).

TABLE 3

| Steel sheet | Steel | Hot-rolled sheet microstructure: Area ratio of bainiate + martensite (%) | Steel sheet microstructure after annealing: Ferrite (%) | Martensite (%) | Pearlite (%) | Bainite (%) | Retained austenite (%) | Average grain size of martensite (μm) | Average adjacent distance of martensite (μm) |
|---|---|---|---|---|---|---|---|---|---|
| 1 | A | 95 | 70 | 22 | 8 | 0 | 0 | 2.1 | 3.2 |
| 2 | | 95 | 70 | 14 | 5 | 7 | 4 | 1.7 | 3.1 |
| 3 | | 60 | 73 | 11 | 6 | 6 | 4 | 3.4 | 6.0 |
| 4 | B | 85 | 68 | 25 | 7 | 0 | 0 | 2.3 | 3.5 |
| 5 | | 85 | 66 | 15 | 4 | 8 | 7 | 2.0 | 3.2 |
| 6 | | 50 | 62 | 18 | 6 | 6 | 8 | 4.2 | 6.5 |
| 7 | | 10 | 60 | 17 | 7 | 8 | 8 | 3.8 | 6.3 |
| 8 | | 85 | 64 | 13 | 6 | 9 | 8 | 3.9 | 6.6 |
| 9 | C | 95 | 65 | 24 | 8 | 2 | 1 | 2.4 | 3.5 |
| 10 | | 95 | 65 | 12 | 6 | 12 | 5 | 2.0 | 3.0 |
| 11 | | 95 | 20 | 33 | 12 | 30 | 5 | 8.0 | 9.5 |
| 12 | | 95 | 75 | 0 | 25 | 0 | 0 | — | — |
| 13 | | 95 | 78 | 3 | 14 | 5 | 0 | 1.9 | 5.3 |
| 14 | D | 90 | 73 | 7 | 5 | 8 | 7 | 1.4 | 4.1 |
| 15 | | 90 | 80 | 3 | 17 | 0 | 0 | 1.1 | 1.3 |
| 16 | E | 95 | 60 | 19 | 8 | 8 | 5 | 2.3 | 3.5 |
| 17 | | 95 | 60 | 40 | 0 | 0 | 0 | 8.5 | 7.8 |
| 18 | | 95 | 60 | 15 | 25 | 0 | 0 | 3.4 | 4.5 |
| 19 | | 95 | 75 | 3 | 2 | 20 | 0 | 0.8 | 4.1 |
| 20 | | 95 | 75 | 3 | 16 | 6 | 0 | 1.2 | 3.1 |
| 21 | | 95 | 75 | 12 | 0 | 6 | 7 | 1.6 | 3.4 |
| 22 | F | 100 | 53 | 32 | 5 | 6 | 4 | 2.7 | 4.3 |
| 23 | G | 100 | 64 | 18 | 6 | 8 | 4 | 2.2 | 3.8 |
| 24 | H | 95 | 72 | 13 | 6 | 6 | 3 | 1.9 | 3.4 |
| 25 | I | 95 | 54 | 12 | 12 | 10 | 12 | 2.8 | 4.4 |
| 26 | J | 30 | 90 | 2 | 5 | 3 | 0 | 1.1 | 3.8 |
| 27 | K | 90 | 85 | 6 | 4 | 5 | 0 | 1.3 | 3.5 |
| 28 | L | 85 | 89 | 0 | 11 | 0 | 0 | — | — |
| 29 | M | 100 | 20 | 61 | 0 | 15 | 4 | 10.5 | 8.6 |
| 30 | E | 95 | 75 | 2 | 17 | 6 | 0 | 1.1 | 2.9 |

TABLE 3-continued

| Steel sheet | Steel | Mechanical characteristics TS (Mpa) | El (%) | TS × EL (MPa · %) | λ (%) | Fatigue limit, FL (MPa) | Duration ratio, FL/TS | Remarks |
|---|---|---|---|---|---|---|---|---|
| 1 | A | 763 | 27 | 20601 | 45 | 365 | 0.48 | Invention example |
| 2 | | 741 | 30 | 22230 | 43 | 366 | 0.49 | Invention example |
| 3 | | 711 | 29 | 20619 | 25 | 314 | 0.44 | Comparative example |
| 4 | B | 801 | 25 | 20025 | 44 | 381 | 0.48 | Invention example |
| 5 | | 791 | 29 | 22939 | 40 | 386 | 0.49 | Invention example |
| 6 | | 815 | 28 | 22820 | 26 | 360 | 0.44 | Comparative example |
| 7 | | 811 | 29 | 23519 | 23 | 355 | 0.44 | Comparative example |
| 8 | | 775 | 30 | 23250 | 25 | 350 | 0.45 | Comparative example |
| 9 | C | 797 | 26 | 20722 | 42 | 381 | 0.48 | Invention example |
| 10 | | 745 | 30 | 22350 | 45 | 386 | 0.52 | Invention example |
| 11 | | 992 | 16 | 15872 | 55 | 384 | 0.39 | Comparative example |
| 12 | | 563 | 26 | 14638 | 45 | 245 | 0.44 | Comparative example |
| 13 | | 598 | 28 | 16744 | 40 | 264 | 0.44 | Comparative example |
| 14 | D | 700 | 35 | 24500 | 53 | 366 | 0.52 | Invention example |
| 15 | | 605 | 28 | 16940 | 38 | 265 | 0.44 | Comparative example |
| 16 | E | 802 | 27 | 21654 | 42 | 387 | 0.48 | Invention example |
| 17 | | 812 | 20 | 16240 | 22 | 325 | 0.40 | Comparative example |
| 18 | | 705 | 25 | 17625 | 28 | 295 | 0.42 | Comparative example |
| 19 | | 650 | 25 | 16250 | 40 | 265 | 0.41 | Comparative example |
| 20 | | 622 | 26 | 16172 | 42 | 262 | 0.42 | Comparative example |
| 21 | | 746 | 30 | 22380 | 20 | 361 | 0.48 | Comparative example |
| 22 | F | 1030 | 21 | 21630 | 40 | 508 | 0.49 | Invention example |
| 23 | G | 782 | 27 | 21114 | 45 | 376 | 0.48 | Invention example |
| 24 | H | 720 | 30 | 21600 | 43 | 348 | 0.48 | Invention example |
| 25 | I | 838 | 31 | 25978 | 41 | 423 | 0.50 | Invention example |
| 26 | J | 597 | 27 | 16119 | 54 | 273 | 0.46 | Comparative example |
| 27 | K | 494 | 32 | 15808 | 50 | 221 | 0.45 | Comparative example |
| 28 | L | 556 | 32 | 17792 | 48 | 244 | 0.44 | Comparative example |
| 29 | M | 1205 | 15 | 18075 | 15 | 465 | 0.39 | Comparative example |
| 30 | E | 618 | 26 | 16068 | 44 | 265 | 0.43 | Comparative example |

The steel sheets of the examples of the present invention show a TS×EL of 20000 MPa·% or more, a λ of 40% or more, an endurance ratio of 0.48 or more, and excellent strength-elongation balance, stretch flangeability, and fatigue resistance. In contrast, the steel sheets of the comparative examples out of the range of the present invention show a TS×EL of less than 20000 MPa·% and/or a λ of less than 40%, and/or an endurance ratio of less than 0.48, and the excellent strength-elongation balance, stretch flangeability, and fatigue resistance of the steel sheets of the present invention cannot be achieved.

According to the present invention, a galvanized steel sheet having excellent formability and fatigue resistance can be produced, and both weight lightening and improvement in crash safety of automobiles can be realized, thereby greatly contributing to higher performance of automobile car bodies.

The invention claimed is:

1. A high-strength galvannealed steel sheet having excellent formability and fatigue resistance, wherein the steel sheet is composed of steel having a composition containing, by % by mass, C: 0.05% to 0.3%, Si: 0.5% to 2.5%, Mn: 1.0% to 3.5%, P: 0.003% to 0.100%, S: 0.02% or less, Al: 0.010% to 0.1%, and the balance including iron and unavoidable impurities, and the steel sheet has a microstructure containing 50% or more of ferrite, 5% to 35% of martensite, and 2% to 15% of pearlite in terms of an area ratio, the martensite having an average grain size of 3 μm or less and an average distance of 5 μm or less between adjacent martensite grains, wherein the steel sheet has a hole expansion rate λ of 40% or more.

2. The high-strength galvannealed steel sheet having excellent formability and fatigue resistance according to claim 1, wherein the microstructure of the steel sheet further contains 5% to 20% of bainite and/or 2% to 15% of retained austenite in terms of an area ratio.

3. The high-strength galvannealed steel sheet having excellent formability and fatigue resistance according to claim 1, wherein the steel further contains, by % by mass, at least one element selected from the group consisting of Cr: 0.005% to 2.00%, Mo: 0.005% to 2.00%, V: 0.005% to 2.00%, Ni: 0.005% to 2.00%, and Cu: 0.005% to 2.00%.

4. The high-strength galvannealed steel sheet having excellent formability and fatigue resistance according to claim 1, wherein the steel further contains, by % by mass, at least one element selected from the group consisting of Ti: 0.01% to 0.20% and Nb: 0.01% to 0.20%.

5. The high-strength galvannealed steel sheet having excellent formability and fatigue resistance according to claim 1, wherein the steel further contains, by % by mass, B: 0.0002% to 0.005%.

6. The high-strength galvannealed steel sheet having excellent formability and fatigue resistance according to claim 1, wherein the steel further contains, by % by mass, one or two elements selected from the group consisting of Ca: 0.001% to 0.005% and REM: 0.001% to 0.005%.

7. A method for manufacturing a high-strength galvannealed steel sheet having excellent formability and fatigue resistance, characterized by hot-rolling a slab containing the components according to claim 1 to produce a hot-rolled sheet having a microstructure in which a total area ratio of bainite and martensite is 80% or more;

cold-rolling the hot-rolled sheet to produce a cold-rolled steel sheet;

continuously annealing the cold-rolled steel sheet by heating to 750° C. to 900° C. at an average heating rate of 8°

C./s or more from 500° C. to an $A_1$ transformation point, holding the steel sheet for 10 seconds or more, and then cooling the steel sheet to a temperature region of 300° C. to 530° C. at an average cooling rate of 3° C./s or more from 750° C. to 530° C.;

galvanizing the steel sheet; and further coating-alloying the steel sheet in a temperature region of 540° C. to 600° C. for 5 to 60 seconds.

8. A method for manufacturing a high-strength galvannealed steel sheet having excellent formability and fatigue resistance, characterized by hot-rolling a slab containing the components according to claim 1 to produce a hot-rolled sheet having a microstructure in which a total area ratio of bainite and martensite is 80% or more;

cold-rolling the hot-rolled sheet to produce a cold-rolled steel sheet;

continuously annealing the cold-rolled steel sheet by heating to 750° C. to 900° C. at an average heating rate of 8° C./s or more from 500° C. to an $A_1$ transformation point, holding the steel sheet for 10 seconds or more, cooling the steel sheet to a temperature region of 300° C. to 530° C. at an average cooling rate of 3° C./s or more from 750° C. to 530° C., and then holding the steel sheet in a temperature region of 300° C. to 530° C. for 20 to 900 seconds;

galvanizing the steel sheet; and further coating-alloying the steel sheet in a temperature region of 540° C. to 600° C. for 5 to 60 seconds.

9. A method for manufacturing a high-strength galvannealed steel sheet having excellent formability and fatigue resistance, characterized by hot-rolling, in a hot-rolling step, a slab containing the components according to claim 1 at a finish rolling temperature equal to or higher than an $A_3$ transformation point, cooling at an average cooling rate of 50° C./s or more, and then coiling at a temperature of 300° C. or more and 550° C. or less to produce a hot-rolled sheet;

cold-rolling the hot-rolled sheet to produce a cold-rolled steel sheet; continuously annealing the cold-rolled steel sheet by heating to 750° C. to 900° C. at an average heating rate of 8° C./s or more from 500° C. to an $A_1$ transformation point, holding the steel sheet for 10 seconds or more, and then cooling the steel sheet to a temperature region of 300° C. to 530° C. at an average cooling rate of 3° C./s or more from 750° C. to 530° C.;

galvanizing the steel sheet; and further coating-alloying the steel sheet in a temperature region of 540° C. to 600° C. for 5 to 60 seconds.

10. A method for manufacturing a high-strength galvannealed steel sheet having excellent formability and fatigue resistance, characterized by hot-rolling, in a hot-rolling step, a slab containing the components according to claim 1 at a finish rolling temperature equal to or higher than an $A_3$ transformation point, cooling at an average cooling rate of 50° C./s or more, and then coiling at a temperature of 300° C. or more and 550° C. or less to produce a hot-rolled sheet;

cold-rolling the hot-rolled sheet to produce a cold-rolled steel sheet;

continuously annealing the cold-rolled steel sheet by heating to 750° C. to 900° C. at an average heating rate of 8° C./s or more from 500° C. to an $A_1$ transformation point, holding the steel sheet for 10 seconds or more, cooling the steel sheet to a temperature region of 300° C. to 530° C. at an average cooling rate of 3° C./s or more from 750° C. to 530° C., and then holding the steel sheet for 20 to 900 seconds in a temperature region of 300° C. to 530° C.;

galvanizing the steel sheet;

and further coating-alloying the steel sheet in a temperature region of 540° C. to 600° C. for 5 to 60 seconds.

* * * * *